US009292986B1

(12) United States Patent
Woodward, III et al.

(10) Patent No.: US 9,292,986 B1
(45) Date of Patent: Mar. 22, 2016

(54) SECURED STORAGE CONTAINER

(71) Applicant: Amazon Technologies, Inc., Reno, NV (US)

(72) Inventors: Neil Whitney Woodward, III, Seattle, WA (US); Christopher Wayne Turner, Leesburg, VA (US); Shane Drexler, Seattle, WA (US); Laura Lynn Legel, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 14/301,503

(22) Filed: Jun. 11, 2014

(51) Int. Cl.
*G07C 9/00* (2006.01)

(52) U.S. Cl.
CPC .... *G07C 9/00912* (2013.01); *G07C 2009/0092* (2013.01)

(58) Field of Classification Search
CPC ..... G07C 9/00912; G07C 2009/0092
See application file for complete search history.

(56) References Cited

U.S. PATENT DOCUMENTS

2005/0289032 A1* 12/2005 Hoblit ..... 705/35

* cited by examiner

*Primary Examiner* — Kristy A Haupt
(74) *Attorney, Agent, or Firm* — Klarquist Sparkman, LLP

(57) ABSTRACT

A secured storage container for transporting storage devices from a data center to a destruction center for degaussing or other destruction techniques. The secured storage container can include a scanner for reading a barcode on the storage devices for inventory tracking. The container can also include a lid that is opened via a security badge for removing the storage devices from the container. A GPS-based tracking module can be used to ensure the container's location is aligned with a route to the destruction center. Finally, the container can have a moveable floor that moves upward as storage devices are removed so that a technician can easily remove all of the storage devices in the container.

21 Claims, 8 Drawing Sheets

SECURED STORAGE CONTAINER

BACKGROUND

Cloud computing is the use of computing resources (hardware and software) which are available in a remote location and accessible over a network, such as the Internet. Users are able to buy these computing resources (including storage and computing power) as a utility on demand. Cloud computing entrusts remote services with a user's data, software and computation. Use of virtual computing resources can provide a number of advantages including cost advantages and/or ability to adapt rapidly to changing computing resource needs.

Large installations of data communication equipment (e.g., routers, switches, servers, etc.) are common in service provider, enterprise, or data center environments. The network topology and functionality implemented in such environments are constantly evolving as the installations are adapted to meet ever-changing needs. Naturally, upgrades of computer equipment requires decommissioning of older equipment. For example, server computers housed in data centers need to be decommissioned on a fairly regular basis. Client-sensitive data on storage media, such as hard drives or solid-state drives, are treated with the utmost security when performing decommissioning of the server computers.

The storage media are often transported to dedicated destruction centers so that the data is not compromised. However, moving the storage media to the destruction centers has proven to be inefficient in terms of tracking the storage media as it is routed from a data center to the destruction center.

A more efficient transport mechanism is desirable that allows trackable inventory control and secured access control.

DETAILED DESCRIPTION

Figure 1:
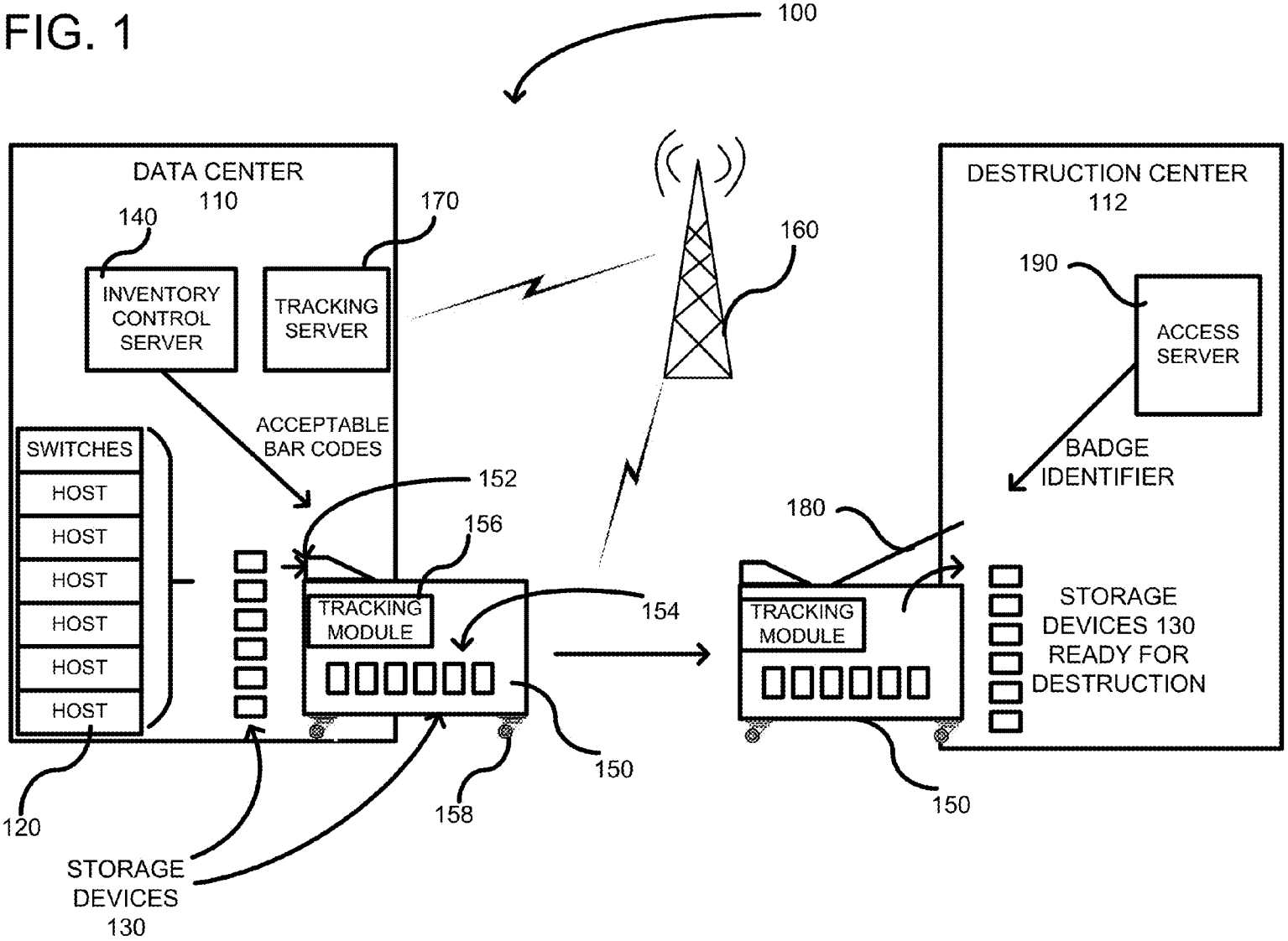
FIG. 1 is a system diagram showing a plurality of storage devices being transported in a secured storage container from a data center to a destruction center.

FIG. 1 shows a system 100 used to transport storage devices, such as hard drives and solid state devices, from a data center 110 to a destruction center 112. The data center 110 can have a plurality of server racks, such as a server rack 120. The server racks include a plurality of host server computers that include storage devices housed therein. When one or more server computers are decommissioned, any storage devices 130 associated with the server computers are removed from the servers and are transported to the destruction center 112 for destruction, such as by degaussing. Data on the storage devices is confidential and should be protected. Accordingly, controls are put in place to securely transport the storage devices 130 between locations. When it is decided to decommission a server rack 120, the rack is reported to an inventory control server 140, which stores identification numbers (e.g., bar codes) associated with the storage devices. More particularly, each storage device can have a bar code (e.g., a sequence of alpha-numeric characters) associated therewith, which is a unique identifier for the storage device. The inventory control server 140 can wirelessly download the identification numbers of the storage devices 130 to be transported to a secured storage container 150. As described more fully below, the container 150 includes a slot 152 in which the storage devices can be inserted. A scanner (not shown in FIG. 1) can be used for inventory control. The scanner can scan the identification numbers on the storage devices 130 and compare the identification numbers to those downloaded from the inventory control server 140. If the storage device inserted into the slot has a scanned identification number that matches one of the identification numbers received from the inventory control server 140, then the storage device is allowed to pass into a storage compartment 154 (also called a recess) within the container 150. A tracking module 156 within the container 150 can be used to collect GPS-based location data and transmit the same to a cellular tower 160. The location data can then be transmitted to a tracking server 170 that can track the container 150 as it moves from the data center 110 to the destruction center 112. The container 150 can include wheels 158 for easy transport of the storage devices.

Once the container 150 reaches the destination, a lid 180 can be opened on the container 150 to remove the storage devices 130 from the storage compartment 154. Typically, the lid includes a fail-secure locking mechanism (not shown in FIG. 1) associated with controlling the opening of the lid. The container 150 can include a badge reader (not shown in FIG. 1) that can read a badge of a person attempting to access the container. An access server 190 can download authorized identification data (e.g., badge numbers) to the container 150. A comparison can be made between an identification badge and the authorized identification data and, if there is a match, the lid can unlock and be opened. The storage devices 130 can then be scanned again at the destruction center 112 as part of the inventory control. The inventory control server 140 can compare the storage device identification numbers that were scanned into the container 150 with the storage device identification numbers that were removed from the container. An error message can be transmitted if the numbers do not match. Alternatively, if the destruction center 112 received all of the storage devices, then they can be destroyed.

Figure 2:
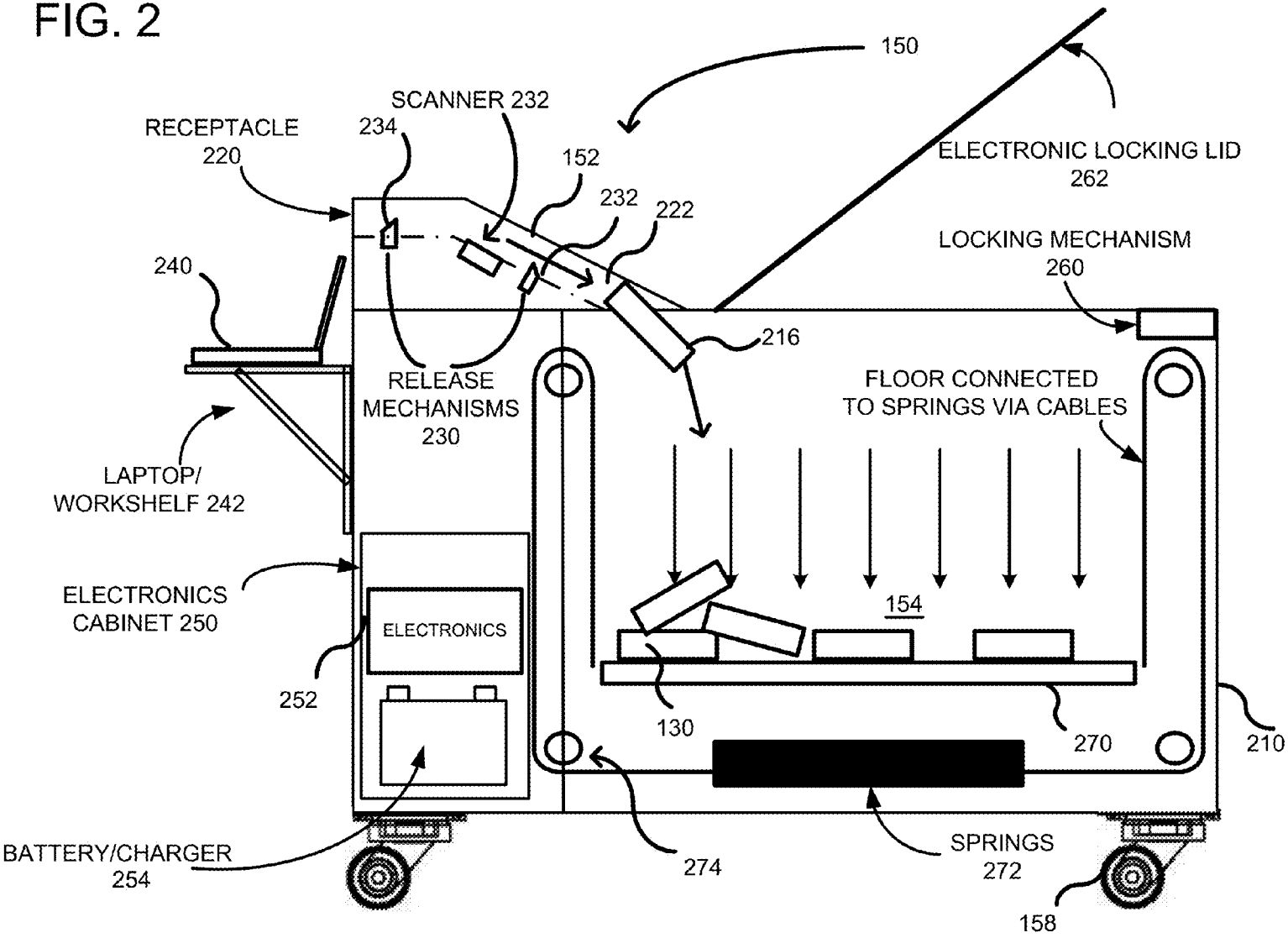
FIG. 2 is an embodiment of the secured storage container of FIG. 1.

FIG. 2 shows an embodiment of the secured storage container 150 in detail. The container includes an outer body 210 forming a recess or storage compartment 154 therein for storing multiple storage devices, shown generally at 130. A particular storage device 216 is shown being deposited into the storage compartment 154 via the slot 152. The slot 152 includes an outer receptacle 220 and a downward sloping chute 222 through which the storage devices can slide into the storage compartment 154. Typically, the slot 152 is sized for fitting only one storage device 130 at a time, but can be expanded to fit additional storage devices, if desired. Positioned within the chute 222 is one or more release mechanisms 230 and a scanner 232. A first release mechanism 232 is downstream of the scanner 232 in the chute 222. The release mechanism 232 is shown as a finger that can stop the storage devices 130 within the chute 222 and prevent them access to the storage compartment 154. A second release mechanism 234 is upstream of the scanner 232 and is used to prevent removal of the storage device after it has been placed in the slot 152 and scanned by the scanner 232. It will be recognized that the scanner 232 and release mechanisms 230 can be oriented differently, such as placing the scanner 232 in a different location. In some embodiments, the scanner 232 can be a hand-held scanner. In any event, the scanner can be integrated with the container, such that it is secured to the container itself. In the example of a hand-held scanner, a flexible cable can secure the hand-held scanner to the container. Additionally, the release mechanisms 230 can be designed in a variety of ways including a trap door that opens and closes. Still further, one or both of the release mechanisms 230 can be removed altogether.

The release mechanisms 230 are generally controlled by a controller, such as is available in a laptop computer 240. The laptop computer 240 can wirelessly receive acceptable identifiers for the storage devices that can be transported within the container. The laptop computer 240, which can be positioned on a laptop shelf 242, can store the acceptable identifiers in local memory. The laptop 240 can further be coupled to the scanner 232 and receive scanned identifiers from the storage devices 130. Before releasing the release mechanism 232, the controller within the laptop 240 can compare the scanned identifier to the list of acceptable identifiers. In the meantime, the release mechanism 232 is selectively blocking the storage mechanism from proceeding further down the chute 222 into the storage compartment 154. Once it is determined that the storage device is authorized to be received into the container, the controller in the laptop computer releases the release mechanism 232 so that the storage device can proceed via gravity down the chute and into the storage compartment. If, on the other hand, the controller determines that the storage device is not authorized to be received in the container, the release mechanism 234 can release the storage device so that it can be pulled back out of the receptacle 220. However, the release mechanism 232 will continue to prevent access of the storage device from proceeding into the container.

An electronics cabinet 250 can include a plurality of electronics 252 (described in relation to FIG. 4) and a battery 254. As further described below, the electronics can include the tracking module 156 from FIG. 1 and further hardware/software for controlling a locking mechanism 260. The locking mechanism 260 can selectively release a lid 262, shown in the open position for removal of the storage devices. The locking mechanism can be a fail-secure lock such that it will remain locked if power is turned off. Consequently, removal of the battery 254 will not allow access to the storage compartment 154.

The container 150 can further include a movable floor 270 positioned within the storage compartment 154, which can move towards the lid and away from the lid 262 in response to an amount of weight on the movable floor. That is, the more storage devices on the floor 270, the lower the floor moves relative to a top of the container 150. As drives are removed, the floor rises vertically to allow ease of removal of the drives. The movable floor can be spring activated through a plurality of springs shown at 272 coupled to pulleys and cables, shown generally at 274. Although shown using a spring and pulley system, the movable floor 270 can be a pure spring-based mechanism. For example, although the springs 272 are shown as horizontally aligned tension springs, the springs can be vertically aligned compression springs. In either case, varying spring lengths can be used for a plurality of springs aligned in parallel, so that some springs engage at different points as the weight increases. Other alternative designs can also be used.

Figure 3:
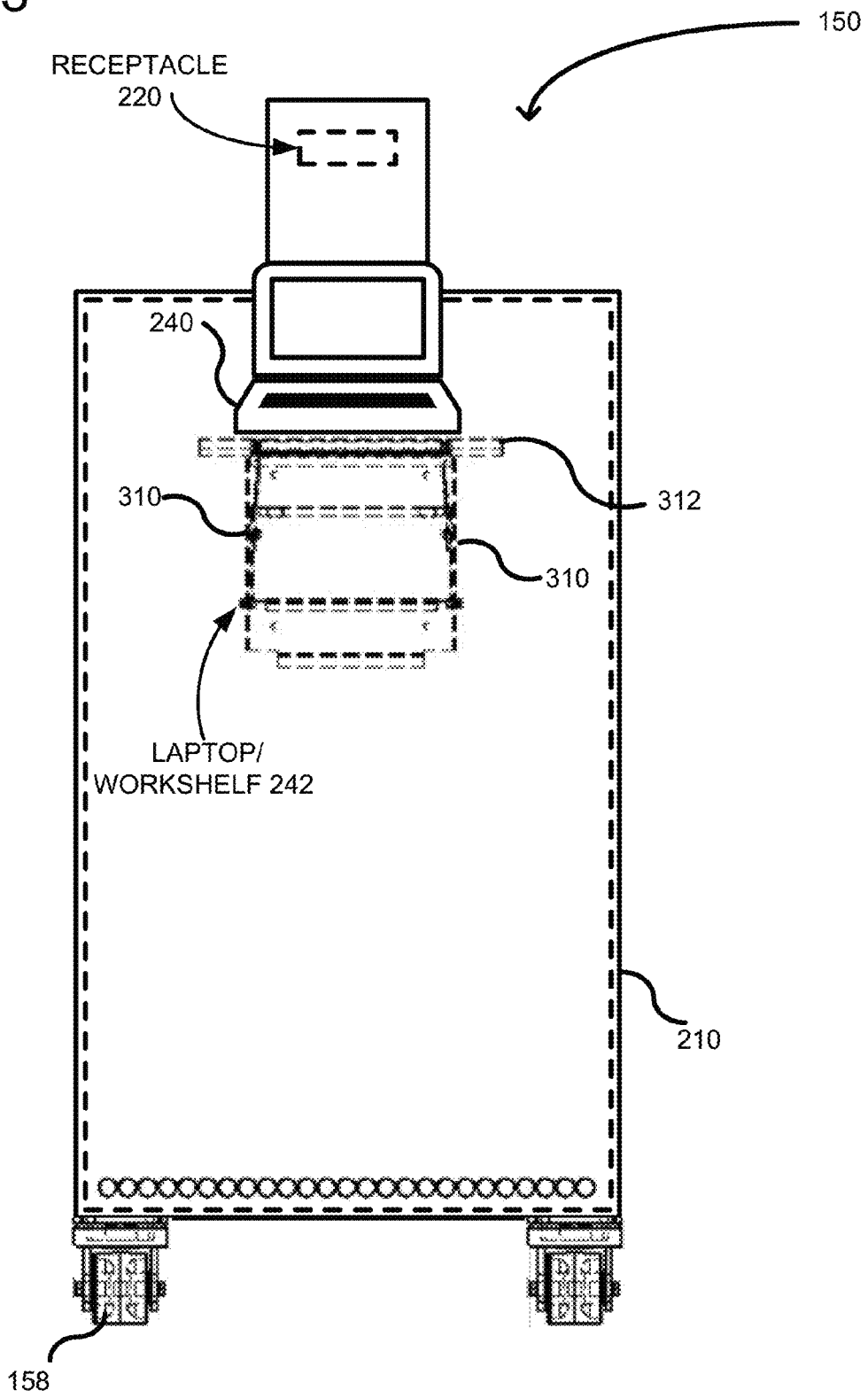
FIG. 3 is an end-elevational view of the storage container of FIG. 2.

FIG. 3 shows an end-elevational view of the secured storage container 150. In this view, the receptacle 220 is seen as being sized for receiving a storage device in a particular configuration. The storage device can be inserted such that the bar code side of the drive is inserted first. Although the receptacle is shown as sized for receiving a single storage drive, it can be sized for receiving additional storage devices, if desired. The laptop/workshelf 242 can have foldable or collapsible side legs 310 that allow a shelf 312 to extend horizontally when in an operable position or fold down vertically in a storage position. The outer body 210 of the container is generally made of metal, such as steel, but other materials can be used.

Figure 4:
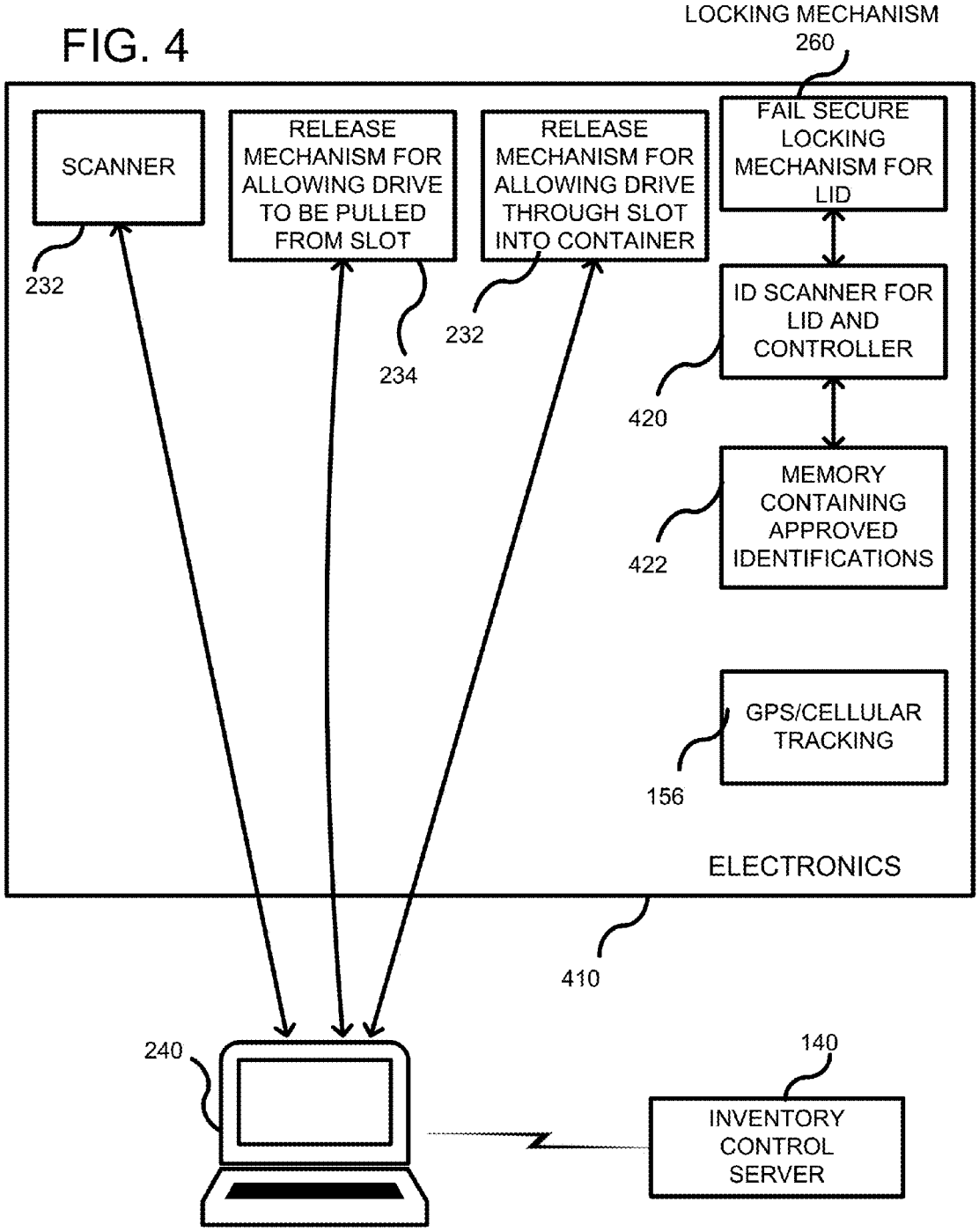
FIG. 4 shows electronic components that can be used in the secured storage container of FIG. 2.

FIG. 4 shows a more detailed view of electronics 410, some of which are included in the electronics 252 stored in the electronics cabinet 250 (see FIG. 2). The electronics 410 include the scanner 232, which can be mounted in the slot or a hand-held scanner. The scanner 232 can be a standard barcode reader that includes a light source, lens and light sensor for translating optical impulses to electrical impulses. The scanner 232 can also include decoder circuitry for analyzing the barcode image data provided by the sensor and digitizing the barcode's content to be delivered on the scanner's output port. The barcode data can then be provided to the laptop computer 240. The laptop computer 240 can also have stored in local memory the authorized bar codes that can be deposited within the container. The authorized bar codes can be downloaded wirelessly from the inventory control server 140. If a scanned bar code matches one of the authorized bar codes, then a USB controller within the laptop computer 240 can control the release mechanism 232 to release the storage device into the container. Additionally, the release mechanism 234 can be in lock mode so that the authorized storage device cannot be removed from the slot. Alternatively, if the bar code is not authorized, then the release mechanism 232 remains locked and the release mechanism 234 releases the storage device so that it can be manually pulled from the slot. In such a case, an audible or visible alarm can be used to alert a technician to remove the storage device from the slot as the stored device is not authorized to be inserted into the storage container.

A GPS/cellular based tracking unit 156 can be located in the container. Commercially available devices are readably available and are typically battery operated. Such devices obtain GPS coordinate data and can transmit location information through a cellular network using a push or pull protocol.

The fail-secure locking mechanism 260 can be controlled by an ID scanner/controller 420. Upon arriving at the destination, the ID scanner/controller can wirelessly communicate with an access server 190 that can download authorized badges to access the container. Such authorized badges can be loaded into the memory 422. In alternative embodiments, the memory 422 can be preloaded at a different location. Or, the access server 190 can dynamically provide authorization information in response to a scan received by the ID scanner 420. In any event, once an authorized scan is obtained, the ID scanner/controller releases the locking mechanism 260 so that the lid of the container can be opened.

Figure 5:
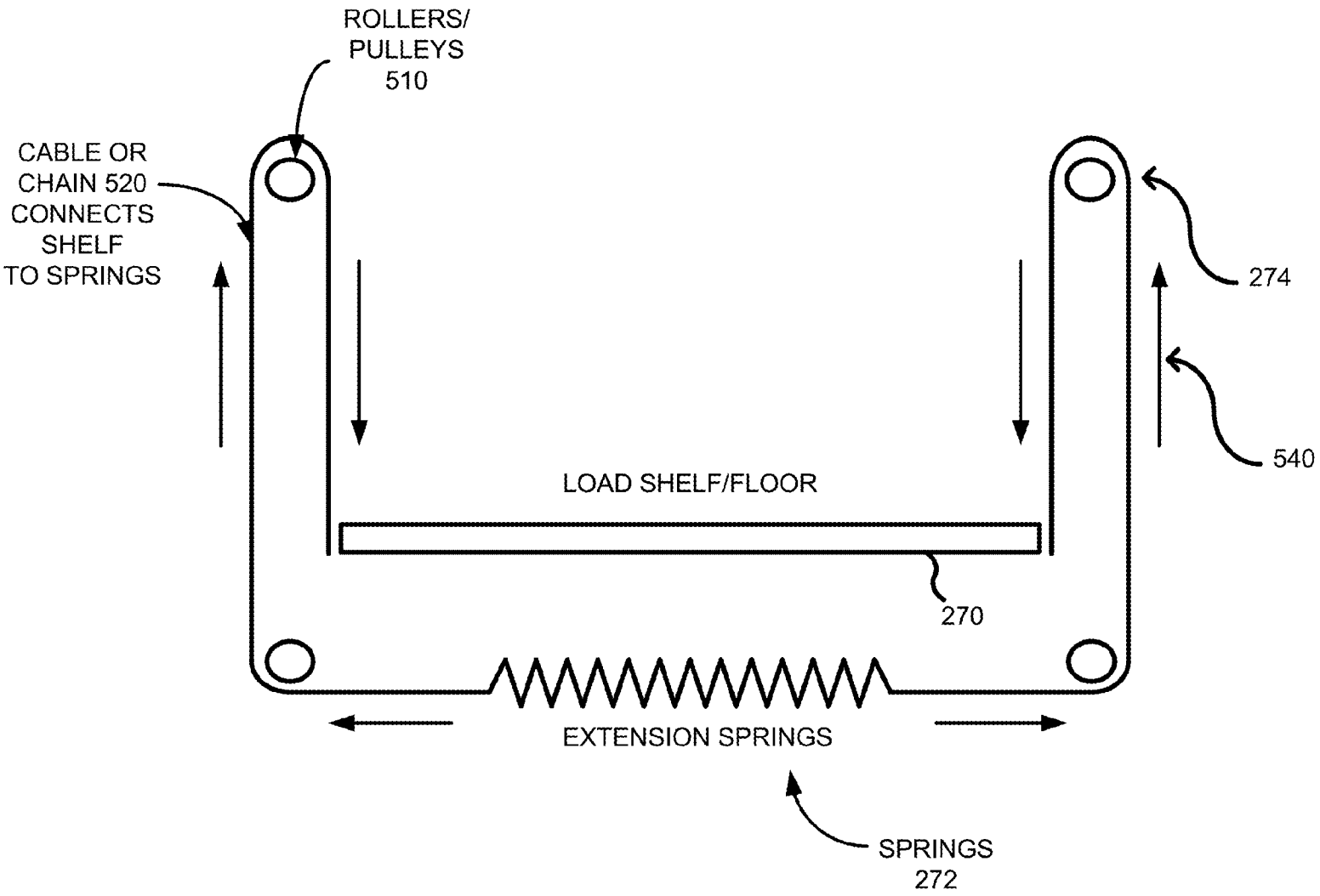
FIG. 5 is an embodiment of a movable floor that can be used in the secured storage container of FIG. 2.

FIG. 5 shows a detailed example of the movable floor section 270 of the container. As previously described, cables and pulleys shown generally at 274 can include pulleys or rollers 510 for allowing movement of the cables/chains 520. Extension springs 272 coupled to the cables 520 extend or contract in accordance with an amount of weight on the movable floor 270. For example, an increase in weight on the floor will cause the cables to move in the direction shown by arrow 540. Removal of weight moves the floor in the opposite direction. The extension springs 272 are typically multiple springs aligned in parallel with different lengths so that they engage at different points along movement of the floor. The movable floor moves to its peak height with no weight on it, and moves towards a base of the container as additional storage devices are added to the container. As storage devices are removed, the floor will automatically move towards the lid allowing a technician to easily remove the storage devices as they are taken out of the container.

Figure 6:
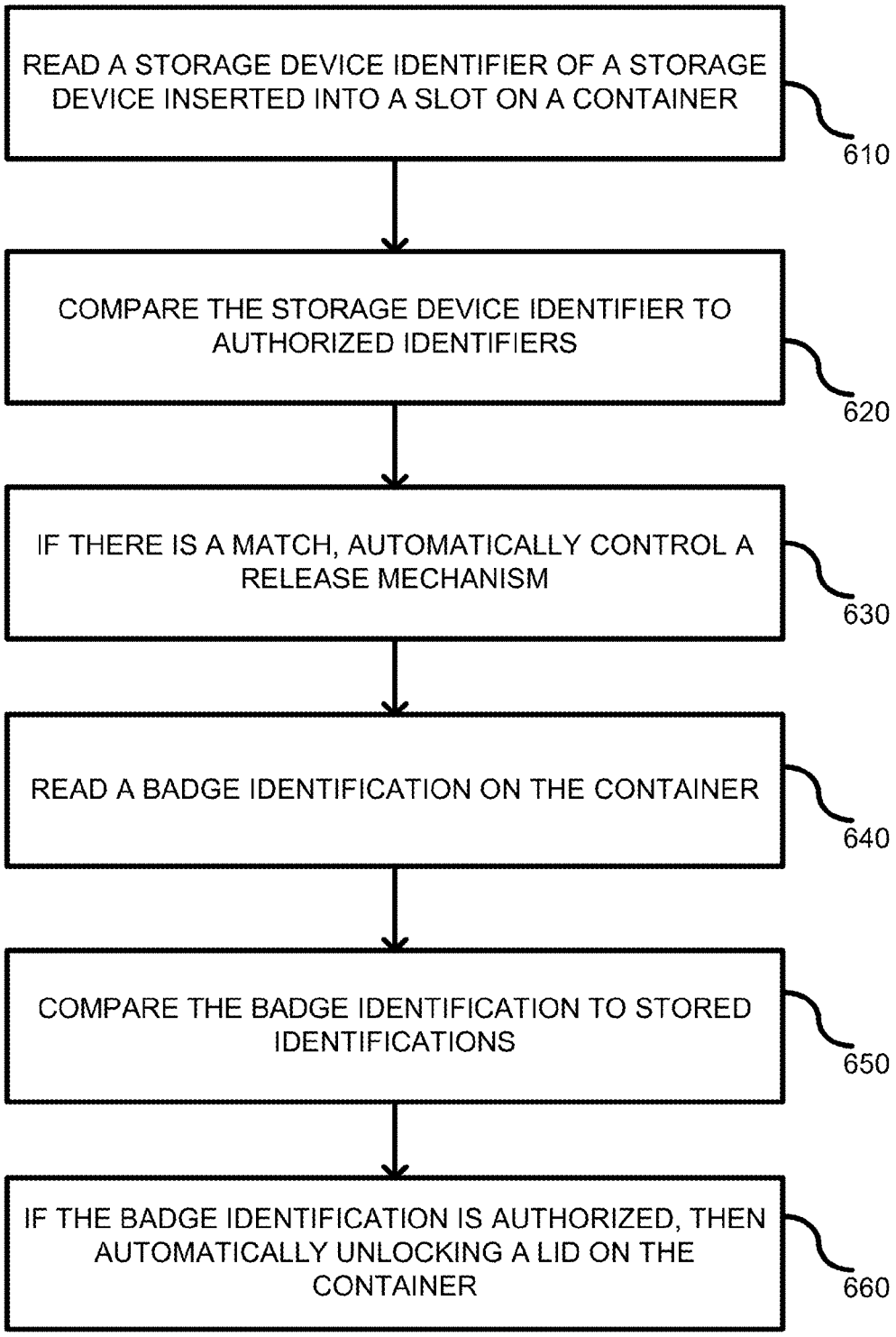
FIG. 6 is a flowchart of a method according to one embodiment for operating the secured storage container of FIG. 2.

FIG. 6 is a flowchart of a method according to one embodiment. In process block 610, a storage device identifier (such as a bar code, QR code, other optical code, RFID, NFC, or other identifiers used in scanning), can be read from a storage device inserted into a slot on the container. The reading of the identifier can be performed with a scanner that is fixed within the slot or it can be a movable hand scanner. In process block 620, the identifier that is read can be compared to authorized identifiers. The authorized identifiers can be stored locally, such as by a laptop computer or another controller located on the container. Alternatively, the authorized identifiers can be retrieved dynamically from a remote server when an identifier is scanned. In process block 630, if there is a match, then one or more release mechanisms can be automatically controlled. For example, a first release mechanism can allow the storage device to slide into the container. At substantially the same time, a second release mechanism can continue to lock the storage device in the chute so as to prevent its removal. Alternatively, if there is not a match, then the first release mechanism can remain locked preventing the storage device from entering the container, and the second release mechanism can unlock allowing the removal of the storage mechanism from the slot. At process block 640, once the container arrives at its destination, such as a destruction center, a badge identification can be read. Badge readers are commercially available wherein when a badge is placed proximate a reader, an electrical field generated by the reader excites a coil in the badge. The coil powers an integrated circuit in the badge that transmits a badge identification code to the reader. In process block 650, the badge identification can be compared to stored identifications. The stored identifications can be downloaded from a local server computer after the container arrives at the destination. In process block 660, if the badge identification matches one of the authorized identifications, then the lid can be automatically unlocked to allow access to the container storage compartment.

Figure 7:
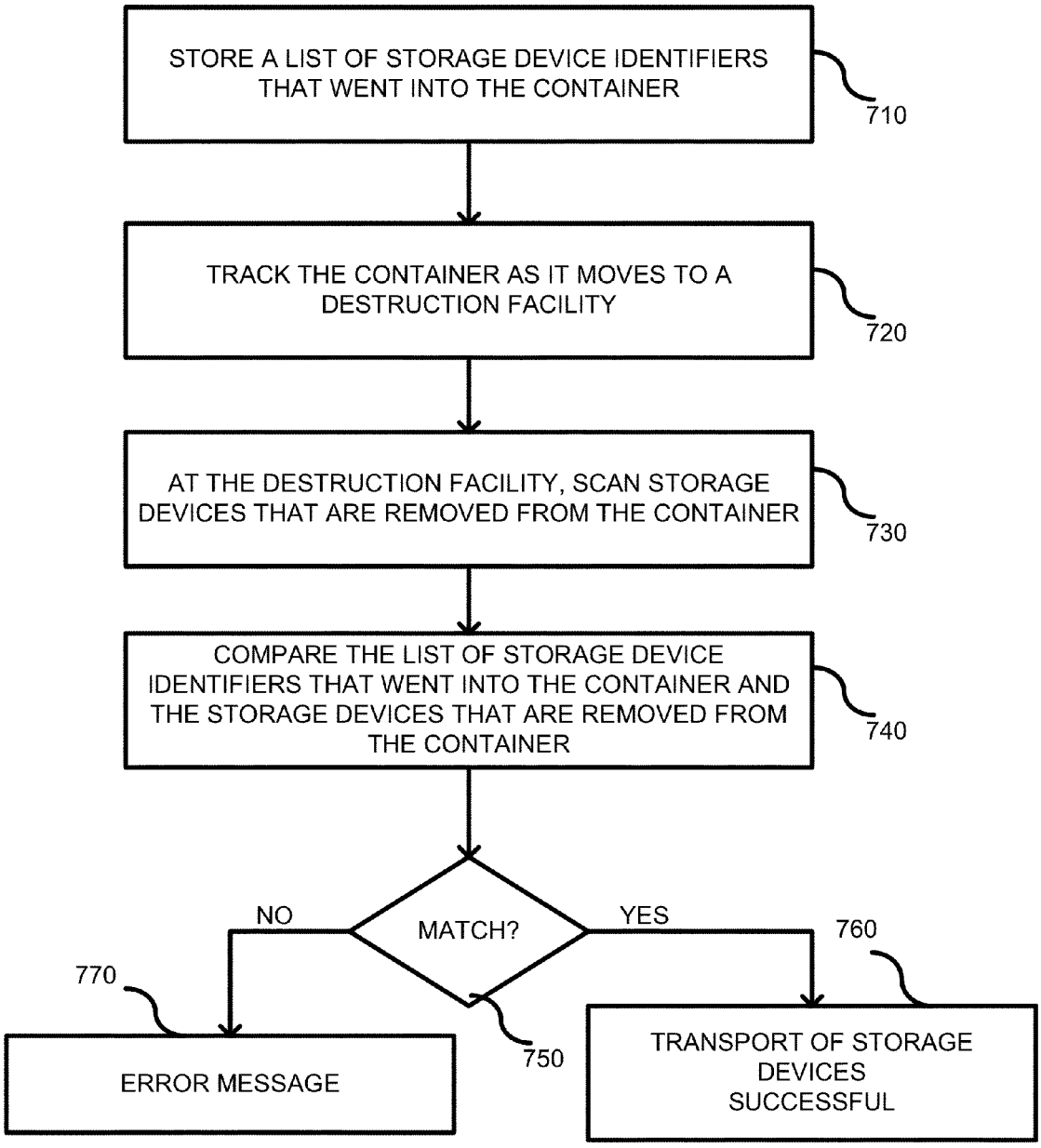
FIG. 7 is a flowchart of a method according to one embodiment for tracking the storage devices being transported in the system of FIG. 1.

FIG. 7 shows a flowchart of a method according to another embodiment. In process block 710, a list of storage device identifiers that were scanned into the container are stored. For example, an inventory control server 140 can wirelessly receive the bar codes that were allowed access into the container. Alternatively, the laptop computer 240 can store the bar codes. In process block 720, the container can be tracked as it moves from the data center (source) to the destruction center (destination). To track the container, the tracking module 156, which can be a GPS/cellular tracking device, can send location information via cellular connection to the tracking server 170. If the container varies off course, the tracking server 170 can provide an alarm to a display to indicate a potential security breach. In process block 730, once the container has reached the destruction facility, the storage devices are scanned by a technician as they are removed from the container. In process block 740, a comparison can be made between the storage devices that went into the container and the storage devices removed from the container to ensure they match. For example, the scanned devices at the destruction center can be compared against the list from process block 710. In decision block 750, a check is made whether there is a match between the devices received at the destruction center and the devices placed in the container. If there is a match, then the transport operation was successful (process block 760). Otherwise, if any of the devices did not reach the destruction center or an identifier on one of the devices is not present on the list, a potential security alert alarm is activated, such as an audio or visual alarm that can be used in conjunction with an overall system server computer (process block 770).

Figure 8:
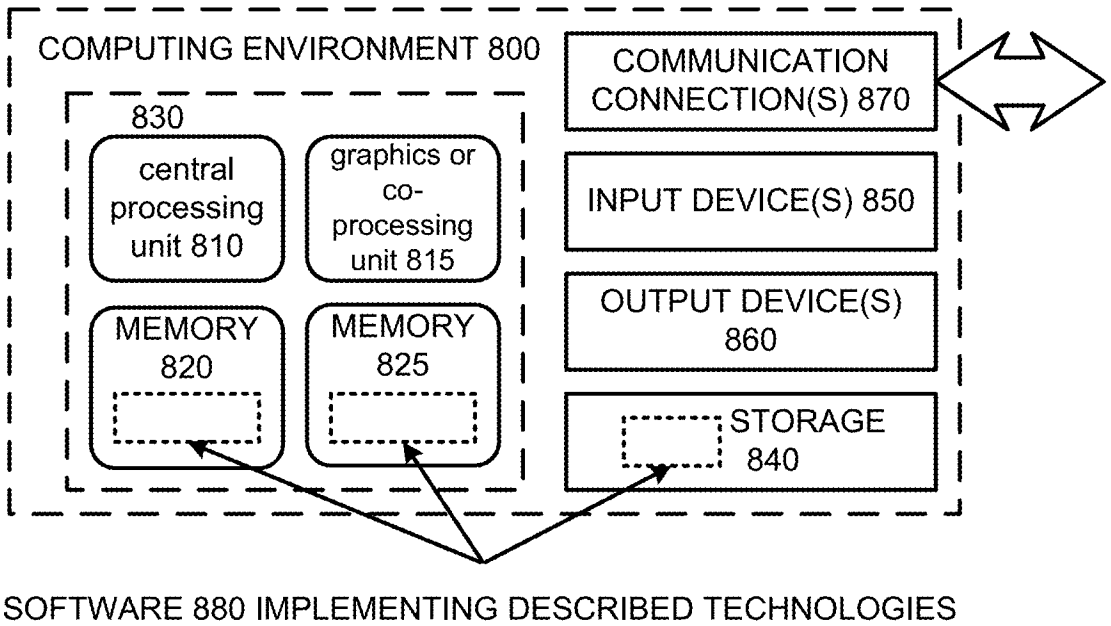
FIG. 8 depicts a generalized example of a suitable computing environment in which the described innovations may be implemented.

FIG. 8 depicts a generalized example of a suitable computing environment 800 in which the described innovations may be implemented. The computing environment 800 is not intended to suggest any limitation as to scope of use or functionality, as the innovations may be implemented in diverse general-purpose or special-purpose computing systems. For example, the computing environment 800 can be any of a variety of computing devices (e.g., desktop computer, laptop computer, server computer, tablet computer, etc.) It should be understood that the computing environment can be used in place of the laptop computer 240 and portions thereof can be operable as a controller that is coupled to the scanner and/or the release mechanisms.

With reference to FIG. 8, the computing environment 800 includes one or more processing units 810, 815 and memory 820, 825. In FIG. 8, this basic configuration 830 is included within a dashed line. The processing units 810, 815 execute computer-executable instructions. A processing unit can be a general-purpose central processing unit (CPU), processor in an application-specific integrated circuit (ASIC) or any other type of processor. The processing unit can also operate as the controller as defined herein. In a multi-processing system, multiple processing units execute computer-executable instructions to increase processing power. For example, FIG. 8 shows a central processing unit 810 as well as a graphics processing unit or co-processing unit 815. The tangible memory 820, 825 may be volatile memory (e.g., registers, cache, RAM), non-volatile memory (e.g., ROM, EEPROM, flash memory, etc.), or some combination of the two, accessible by the processing unit(s). The memory 820, 825 stores software 880 implementing one or more innovations described herein, in the form of computer-executable instructions suitable for execution by the processing unit(s).

A computing system may have additional features. For example, the computing environment 800 includes storage 840, one or more input devices 850, one or more output devices 860, and one or more communication connections 870. An interconnection mechanism (not shown) such as a bus, controller, or network interconnects the components of the computing environment 800. Typically, operating system software (not shown) provides an operating environment for other software executing in the computing environment 800, and coordinates activities of the components of the computing environment 800.

The tangible storage 840 may be removable or non-removable, and includes magnetic disks, magnetic tapes or cassettes, CD-ROMs, DVDs, or any other medium which can be used to store information in a non-transitory way and which can be accessed within the computing environment 800. The storage 840 stores instructions for the software 880 implementing one or more innovations described herein.

The input device(s) 850 may be a touch input device such as a keyboard, mouse, pen, or trackball, a voice input device, a scanning device, or another device that provides input to the computing environment 800. The output device(s) 860 may be a display, printer, speaker, CD-writer, or another device that provides output from the computing environment 800.

The communication connection(s) 870 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions stored on one or more computer-readable storage media (e.g., one or more optical media discs, volatile memory components (such as DRAM or SRAM), or non-volatile memory components (such as flash memory or hard drives)) and executed on a computer (e.g., any commercially available computer, including smart phones or other mobile devices that include computing hardware). The term computer-readable storage media does not include communication connections, such as signals and carrier waves. Any of the computer-executable instructions for implementing the disclosed techniques as well as any data created and used during implementation of the disclosed embodiments can be stored on one or more computer-readable storage media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

It should also be well understood that any functionality described herein can be performed, at least in part, by one or more hardware logic components, instead of software. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

For example, although the above-described embodiments used storage devices as an example, the container can be used to transport other objects that have security concerns.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

What is claimed is:

1. A secured storage container, comprising:

a container outer body forming a recess therein to securely transport storage devices;

a slot formed in the container and sized for receiving at least one of the storage devices at a time so that the storage devices can enter into the recess within the container;

a scanner coupled to the container and positioned adjacent the slot for reading identifiers on the storage devices as they pass through the slot;

a controller coupled to the scanner for receiving the identifiers and for determining whether the storage devices are authorized to be received into the recess;

a release mechanism positioned to selectively restrict the storage devices from being moved from the slot to the recess in response to control signals from the controller;

a lid on the container allowing access to the recess;

a locking mechanism coupled to the lid for unlocking or locking the lid; and a movable floor positioned within the recess of the container that moves towards the lid and away from the lid in response to an amount of weight on the movable floor.

2. The secured storage container of claim 1, wherein the release mechanism is a first release mechanism and further including a second release mechanism positioned within the slot to control removal of the storage device after being placed in the slot.

3. The secured storage container of claim 1, wherein the slot includes an outer receptacle and a chute coupling the recess of the container to the receptacle.

4. The secured storage container of claim 1, further including a tracking unit mounted within the container for identifying a position of the container.

5. A system for transporting devices, comprising:

a container having a storage compartment therein to carry the devices;

a slot, formed in the container, sized to receive the devices and allow the devices to be deposited in the storage compartment, the slot including an outer receptacle and a downward sloping chute;

a release mechanism selectively blocking the slot to control whether the devices can pass through the slot into the storage compartment, wherein the release mechanism is positioned within the slot such that a blocked device can be pulled back out through the outer receptacle;

a scanner integrated with the container for reading identifiers on the devices; and a controller coupled to the scanner and the release mechanism for controlling the release mechanism based on the identifiers received from the scanner.

6. The system of claim 5, wherein the slot includes an outer receptacle and a chute coupling the storage compartment to the outer receptacle.

7. The system of claim 6, wherein the scanner is positioned within the chute.

8. The system of claim 6, wherein the scanner is a handheld scanner attached to the container.

9. The system of claim 5, further including a lid coupled on the container for allowing access to the storage compartment, the lid having a fail-secure locking mechanism associated therewith for controlling opening and closing of the lid.

10. The system of claim 9, wherein the locking mechanism is controlled by a badge reader that reads an identification badge and compares identification data thereon to stored approved identification data.

11. The system of claim 5, further including a tracking unit within the container for providing location information for the container.

12. The system of claim 5, wherein the release mechanism is a first release mechanism and further including a second release mechanism for controlling whether a device in the slot can be removed out of the slot.

13. The system of claim 5, wherein the controller is within a laptop computer mounted to the container.

14. The system of claim 5, wherein the devices are storage devices.

15. A computer-readable storage, which is non-transitory, having instructions thereon for executing a method, the method comprising:

reading a storage device identifier on a storage device that is inserted into a slot on a container;

comparing the storage device identifier to authorized identifiers stored in memory;

if the storage device identifier matches one of the authorized identifiers, then automatically controlling a release mechanism on the container to allow the storage device to pass from the slot into a storage compartment within the container;

reading a badge identification on a reader located on the container;

comparing the badge identification to stored identifications to determine whether the badge identification is authorized; and if the badge identification matches one of the stored identifications, then automatically unlocking a lid on the container to allow access to the storage compartment.

16. The computer-readable storage of claim 15, further including transmitting location information from a tracking module within the container as it moves towards a storage device destruction facility.

17. The computer-readable storage of claim 15, further including receiving the stored identifications from an access server located at the destruction center so that the lid can only be unlocked after the container reaches its desired destination.

18. The computer-readable storage of claim 15, wherein the release mechanism is a first release mechanism and further including controlling a second release mechanism that holds the storage device in the slot but releases the storage device to be removed from the slot if the storage device identifier does not match one of the authorized identifiers.

19. The computer-readable storage of claim 15, further including comparing the storage device identifiers that passed through the slot into the container at a source location to the storage device identifiers that are removed from the container at a destination location and transmitting an error message if the comparison does not match.

20. The computer-readable storage of claim 15, further including comparing the storage device identifiers that passed through the slot into the container at a source location to the storage device identifiers that are removed from the container at a destination location and transmitting an error if any of the storage device identifiers did not arrive at the destination location.

21. A system for transporting devices, comprising:

a container having a storage compartment therein to carry the devices;

a slot, formed in the container, sized to receive the devices and allow the devices to be deposited in the storage compartment;

a release mechanism selectively blocking the slot to control whether the devices can pass through the slot into the storage compartment;

a scanner integrated with the container for reading identifiers on the devices;

a controller coupled to the scanner and the release mechanism for controlling the release mechanism based on the identifiers received from the scanner; and a lid coupled on the container for allowing access to the storage compartment, the lid having a fail-secure locking mechanism associated therewith for controlling opening and closing of the lid, wherein the locking mechanism is controlled by a badge reader that reads an identification badge and compares identification data thereon to stored approved identification data.

* * * * *